United States Patent [19]

Shih et al.

[11] 4,421,633

[45] Dec. 20, 1983

[54] LOW PRESSURE CYCLIC HYDROCRACKING PROCESS USING MULTI-CATALYST BED REACTOR FOR HEAVY LIQUIDS

[75] Inventors: Stuart S. Shih; Donald Milstein, both of Cherry Hill, N.J.

[73] Assignee: Mobil Oil Corporation, New York, N.Y.

[21] Appl. No.: 243,414

[22] Filed: Mar. 13, 1981

[51] Int. Cl.[3] ..... C10G 69/02; C10G 45/08; C10G 47/04

[52] U.S. Cl. ..... 208/59; 208/89; 208/210; 208/216 PP; 208/251 H

[58] Field of Search ..... 208/59, 216 PP, 251 H, 208/210, 89

[56] References Cited

U.S. PATENT DOCUMENTS

| | | | |
|---|---|---|---|
| 3,549,515 | 12/1970 | Brainard et al. | 208/59 |
| 3,669,873 | 6/1972 | Jaffe et al. | 208/59 |
| 3,730,879 | 5/1973 | Christman et al. | 208/210 |
| 3,905,893 | 9/1975 | Christman et al. | 208/210 |
| 4,016,067 | 5/1977 | Fischer et al. | 208/251 H |
| 4,022,682 | 5/1977 | Bludis et al. | 208/89 |
| 4,116,817 | 9/1978 | Frayer et al. | 208/210 |
| 4,212,729 | 7/1980 | Hensley et al. | 208/216 PP |
| 4,257,872 | 3/1981 | LaPierre et al. | 208/59 |
| 4,298,458 | 11/1981 | Banta et al. | 208/112 |
| 4,302,323 | 11/1981 | Chen | 208/89 |

*Primary Examiner*—Delbert E. Gantz
*Assistant Examiner*—O. Chaudhuri
*Attorney, Agent, or Firm*—Charles J. Speciale; Michael G. Gilman; Alexander J. McKillop

[57] ABSTRACT

Resids are hydrocracked at low pressure (600 psig and 825° F.) in a solvent, while being demetalated, desulfurized, and decarbonized, by passing the solution through a dual-bed catalytic system having a large-pore catalyst as the first bed and a small-pore as the second bed. The solvent is preferably process generated and recycled, boiling at about 400°-700° F.

9 Claims, 9 Drawing Figures

LOW PRESSURE CYCLIC HYDROCRACKING PROCESS USING MULTI-CATALYST BED REACTOR FOR HEAVY LIQUIDS

BACKGROUND OF THE INVENTION

1. Field of the Invention

This invention relates to an improved process for catalytically hydrocracking residuums in a solvent and further relates to demetalation, desulfurization, and decarbonization thereof. It especially relates to using a dual-bed catalyst system having a large-pore catalyst as the first bed and a small-pore catalyst as the second bed. It specifically relates to recycling a process-generated distillate (boiling at about 400°–700° F.) as the solvent.

2. Description of the Prior Art

Residual petroleum oil fractions produced by atmospheric or vacuum distillation of crude petroleum are characterized by relatively high metals, sulfur, and/or CCR content. This comes about because practically all of the metals present in the original crude remain in the residual fraction, attached to polycyclic and highly aromatic compounds, and a disproportionate amount of sulfur in the original crude oil also remains in that fraction. Principal metal contaminants are nickel and vanadium, with iron and small amounts of copper also sometimes present. Additionally, trace amounts of zinc and sodium are found in some feedstocks. The high metals content of the residual fractions generally preclude their effective use as charge stocks for subsequent catalytic processing such as catalytic cracking and hydrocracking. This is so because the bulk of the metal contaminants are contained in pentane-insoluble, high-boiling asphaltenes that are sheet-like structured materials in the residuum petroleum oil fractions.

The asphaltenes are readily adsorbed on the surface of the catalysts, and the metals, such as vanadium and nickel, which are primarily associated with the asphaltenes, are deposited on the catalyst particles, thus blocking the catalyst pores and preventing other molecules from comin into contact with the active catalyst sites. Asphaltenes are responsible for the rapid catalyst deactivation and formation of inordinate amounts of coke, dry gas, and hydrogen that are usually observed in residual oil hydrodesulfurization. Furthermore, at high temperatures, the asphaltene molecules polymerize and cause plugging of the catalyst bed in high conversion operations.

In order to avoid this rapid catalyst deactivation due to the asphaltenes, it is a practice in the prior art to only treat a portion of the resid feed. The vaccum gas oil is separated by distillation, hydrotreated, and then blended back with the residual oil material. This prevents the contacting of the catalyst with asphaltenes. A major problem arises under the foregoing method when the production of a low sulfur fuel is desired, since the sulfur contained in the asphaltene molecules represents a significant portion of the total sulfur and has not been removed.

It is current practice to upgrade certain residual fractions by a pyrolitic operation known as coking. In this operation, the residuum is destructively distilled to produce distillates of low metals content and leave behind a solid coke fraction that contains most of the metals. Coking is typically carried out in a reactor or drum operated at about 800° to 1100° F. temperature and a pressure of one to ten atmospheres. The economic value of the coke by-product is determined by its quality, especially its sulfur and metals content. Excessively high levels of these contaminants make the coke useful only as low-valued fuel. In contrast, cokes of low metals content, for example up to about 100 p.p.m. (parts-per-million by weight) of nickel and vanadium, and containing less than about 2 weight percent sulfur, may be used in high-valued mettallurgical, electrical, and mechanical applications.

Carbon residue may be determined by the Conradson Carbon Residue test. This test is important because Conradson carbon precursors generate surface coke on a catalyst, and the excess formation of coke upsets the heat balance of the catalytic cracking process. In general, higher-boiling range fractions contain more Conradson carbon or coke precursors. Light distillate oils may have a carbon residue less than 0.05 percent, but a vacuum residual oil may have a Conradson carbon value of 10 percent to 30 percent. Such a high Conradson carbon content, particularly when combined with excessive metals content, essentially renders ineffective most conventional catalysts and catalytic treating processes.

The effect of such high carbon residue is that many residual petroleum feedstocks are unsuitable for use as FCC feedstocks, even if metals content and sulfur content are at acceptably low values.

Certain residual fractions are currently subjected to visbreaking, which is a heat treatment of milder conditions than used in coking, in order to reduce their viscosity and make them more suitable as fuels. Again, excessive sulfur content sometimes limits the value of the product.

Residual fractions are sometimes used directly as fuels. For this use, a high sulfur content in many cases is unacceptable for ecological reasons.

At present, catalytic cracking is generally done by utilizing hydrocarbon chargestocks lighter than residual fractions which generally have an API gravity less than 20. Typical cracking chargestocks are coker and/or crude unit gas oils, vacuum tower overhead, etc., the feedstock having an API gravity from about 15 to about 45. Since these cracking chargestocks are distillates, they do not contain significant proportions of the large molecules in which the metals are concentrated. Such cracking is commonly carried out in a reactor operated at a temperature of about 800° to 1500° F., a pressure of about 1 to 5 atmospheres, and a space velocity of about 1 to 1000 LHSV.

Although mostly demetalated, these feedstocks are high in sulfur. The most practical commercial means of desulfurizing such feedstocks as well as the resids themselves is the catalytic dehydrogenation of sulfur-containing molecules and petroleum hydrocarbon feeds in order to effect the removal, as hydrogen sulfide, of the sulfur-containing molecules therein. These processes generally require relatively high hydrogen pressures, generally ranging from about 700 to 3000 psig, and elevated temperatures generally ranging from 650° to 800° F., depending upon the feedstock employed and the degree of desulfurization required.

Such catalytic processes are generally quite efficient for the desulfurization of distallate-type feedstocks but become of increasing complexity and expense and decreasing efficiency as increasingly heavier feedstocks, such as whole or topped crudes and residua, are employed. This is particularly true with regard to asphaltene-containing feedstocks, including residuum feedstocks, since such feedstocks are often contaminated with heavy metals, such as nickel, vanadium and iron, as well as with the asphaltenes themselves, which tend to deposit on the catalyst and deactivate same. Furthermore, a large portion of the sulfur content in these feeds is generally contained in the higher molecular weight molecules, which can only be broken down under the more severe operating conditions, and which generally cannot diffuse through the catalyst pores.

In any case, the residual fractions of typical crudes will require treatment to reduce the metals content. As almost all of the metals are combined with the residual fraction of a crude stock, it is clear that at least about 80% of the metals and preferably at least 90% needs to be removed to produce fractions suitable for cracking chargestocks.

Metals and sulfur contaminants present similar problems with regard to hydrocracking operations which are typically carried out on chargestocks even lighter than those charged to a cracking unit. Hydrocracking catalyst is so sensitive to metals poisoning that a preliminary or first stage is often utilized for trace metals removal. Typical hydrocracking reactor conditions consist of a temperature of 400° to 1000° F. and a pressure of 100 to 3500 psig.

It is evident that there is considerable need for an efficient method to reduce the metals and/or sulfur content and/or residual carbon content of petroleum oils, and particularly of residual fractions of these oils. While the technology to accomplish this for distillate fractions has been advanced considerably, attempts to apply this technology to residual fractions generally fail because of very rapid deactivation of the catalyst, presumably by metals and coke deposition on the catalyst.

U.S. Pat. No. 3,696,027, issued Oct. 3, 1972, and U.S. Pat. No. 3,663,434, issued May 16, 1972, describe a process for hydrodesulfurization of a metals-contaminated heavy oil which comprises: (a) passing a heavy oil, at elevated temperature and pressure and in the presence of hydrogen, through a fixed bed of macro-porous catalyst particles having high metals capacity and a low desulfurization activity, (b) passing effluent from the macro-porous catalyst bed, at elevated temperature and pressure and in the presence of hydrogen, through a fixed bed of moderately active desulfurization catalyst particles, and (c) passing effluent from the bed of moderately active desulfurization catalyst particles, at elevated temperature and pressure and in the presence of hydrogen, through a fixed bed of highly active desulfurization catalyst particles.

It was ascertained that a high active hydrodesulfurization catalyst becomes deactivated relatively rapidly when there is no meals removal or catalyst contacting procedure applied to metals-contaminated heavy oil feed prior to hydrodesulfirization of the heavy oil passing through the fixed bed. It was also determined that using a catalyst bed which comprises a macro-porous catalyst to hydrotreat the heavy oil, prior to passing the heavy oil through the high active hydrodesulfurization catalyst bed, results in a surprisingly high degree of sulfur removal over extended periods of time even though using an equal amount or even less total catalyst than when only the highly active hydrodesulfurization catalyst is used.

However, even the macro-porous catalyst tends to become plugged fairly rapidly if it has moderate or substantial desulfurization activity so that the process becomes economically unattractive because of power loss caused by pressure drop and othe operating difficulties. Nevertheless, inversely grading the catalyst system according to particle size, as disclosed in U.S. Pat. No. 3,496,099, copes with this problem.

U.S. Pat. No. 3,775,290, issued Nov. 27, 1973, discloses a process for hydrotreating a whole desalted crude oil, mixed with a recycled stream from a catalytic cracking unit, such as heavy catalytic cycle oil, before fractionating to produce a gas oil for catalytic cracking.

U.S. Pat. No. 3,891,538, issued June 24, 1975, describes an integrated hydrocarbon conversion process which includes hydrodesulfurizing a heavy hydrocarbon feedstock boiling above 650° F. which is mixed with a cycle oil fraction from a catalytic zone (boiling at about 430°-800° F.) and with a coker gas oil (boiling at about 400°-900° F.) to produce a hydrodesulfurized mixture which, upon fractionating, yields a fraction boiling in the range of 650°-1000° F. for catalytic cracking and a fraction boiling at above 1000° F. for coking.

U.S. Pat. No. 3,893,911, issued July 8, 1975, discloses a process for demetalization of certain petroleum residua and particularly for vanadium removal by initially depositing vanadium on the catalyst during initial hydrogenation contact with metal-containing feedstocks in an ebulliated bed reaction zone, using activated alumina or activated bauxite catalysts, and, if desired, a second stage reaction zone for desulfurization, using a high activity desulfurization catalyst material, such as cobalt, molybdenum, nickel, or oxide and sulfide thereof and the mixtures thereof on a carrier such as alumina, silica, and mixtures thereof.

U.S. Pat. No. 3,976,559, issued Aug. 24, 1976, teaches a process for the combined hydrodesulfurization and hydroconversion of certain heavy asphaltene-containing hydrocarbon feedstocks, such as residua feedstocks. Such hydrocarbon feedstocks are initially contacted with a hydrodesulfurization catalyst which is effective for the selective hydrodesulfurization of the lower-boiling components thereof, thus avoiding conversion of the asphaltene components thereof, while removing between about 30 and 80 percent of the sulfur therein. Subsequently, the partially desulfurized products of this catalytic hydrodesulfurization step are then contacted with an alkali metal in a conversion zone at elevated temperatures in the presence of added hydrogen, so that at least about 90 percent of the sulfur originally contained in the initial hydrocarbon feedstocks is removed therefrom while at least about 50 percent of the 1050° F.+ portion of the feedstock is converted to lower-boiling products. The pore diameter of the catalyst is about 10-100 Angstroms, preferably 20-80 Angstroms, and most preferably 30-50 Angstroms, whereby the asphaltene agglomerates, including most of the metal-containing components, do not have access to the catalyst surfaces thereof, thus avoiding the problems of contamination and deactivation of the catalyst surfaces with these components while accomplishing hydrodesulfurization of lower-boiling components so that 50-80 percent of initially contained suflur in these feedstocks is removed.

SUMMARY OF THE INVENTION

It is, therefore, an object of this invention to hydrocrack solvent-diluted resids in a single pass-through operation for converting high-boiling point resids, such as atmospheric resids and vacuum resids, to low-boiling point hydrocarbons while removing heteroatoms, metals, and carbon residuals.

It is also an object to hydrodesulfurize the feedstock during the same hydrocracking operation.

It is another object to accomplish such hydrocracking while minimizing metals deposition on the catalyst and the blocking of the catalyst pores by asphaltenes, whereby the catalyst remains usable for runs of commercially acceptable length, by utilizing large-pore catalysts followed by small-pore catalysts.

It is a further object to provide a hydrocracking process wherein process-derived distillates (400°–700° F.) are recycled as the solvent for the resids.

An additional object is to recycle a process-generated distillate to mix with resid as a solvent before feeding to the top of the reactor.

In accordance with these objectives and the principles of this invention, a hydrocracking process is herein provided which utilizes a multi-catalyst bed reactor in which the pore size of the catalyst decreases gradually from the top of the reactor to the bottom of the reactor. In its simplest combination, the reactor is packed with a large-pore catalyst in the top and with a small-pore catalyst in the bottom.

The large-pore catalyst is preferably a 1/32-inch Ni-W/$Al_2O_3$ having a surface area of about 100 square meters per gram and a pore volume of about 0.5 cc/g, with a pore diameter of about 180 A. Most of its pore size distribution is above 100 A.

The small-pore catalyst has about twice as much NiO and $WO_3$ as the large-pore catalyst, about twice the surface area, about 70 percent of the pore volume, about one-third of the pore diameter, a slightly higher real density, and about one-third higher particle density. The pellet size is 8/14 mesh, and its pore size distribution, in cc/g, is entirely below 80 A.

The first catalyst encountered by the mixture of recycled process-generated distillate and resid is the large-pore catalyst and the second is the small-pore catalyst which are in the ratio of 10/1 to 1/10, by weight. Both the large-pore catalyst and the small-pore catalyst are $Al_2O_3$ which is impregnated with molybdenum and tungsten oxides and with iron, cobalt, and nickel oxides. The NiO is 3.5% by weight in the large-pore catalyst and 6.5% by weight in the small-pore catalyst.

The $WO_3$ is about 10.0% by weight in the large-pore catalyst and about 19.7% by weight in the small-pore catalyst. The large-pore catalyst has a pore size distribution which is characterized by the majority of its pores being larger than 100 Angstroms in diameter, and the small-pore catalyst has substantially all of its pores no more than 80 Angstroms in diameter.

It has been found that the dual catalyst system is unexpectedly superior, because the small-pore catalyst ages significantly faster than the large-pore catalyst and is less active for metal removal. Catalyst cycling for up to 10 days of hydrodesulfurization at 70 percent, metals removed at up to 80 percent, and CCR reduction at up to 50 percent has been obtained.

Recycle of a process-generated distillate, boiling at about 400°–700° F., has been investigated and shown to be equivalent to recycling FCC light cycle oil to the low-pressure resid hydrocracker, using in each instance a 2/1 mixture of resid/cycle oil for a distillate. Both solvents gave approximately comparable results with respect to demetalization, desulfurization, and decarbonization or CCR reduction.

Direct conversion of residua to distillate and naphtha at low pressure is very attractive. The process described herein involves cyclic operation of a fixed bed reactor at a pressure of about 600 psig. This process could replace conventional resid high pressure upgrading approaches, such as high pressure hydrotreating/FCC at 2000 psig $H_2$ or high pressure hydrocracking.

BRIEF DESCRIPTION OF THE DRAWINGS

The invention may be more completely understood by study of the accompanying drawings.

DETAILED DESCRIPTION OF THE INVENTION

An investigation was made in a pilot unit as to hydroprocessing performance with certain catalysts and then with certain diluent oils. The table shows detailed properties of the catalyst.

EXAMPLE 1

A pilot reactor was packed with a large-pore NiW-/$Al_2O_3$ catalyst having 1/32-inch diameter. A blend of 2/1 Arabian light atmospheric resid/FCC light cycle oil was run therethrough at 0.45 LHSV, 600 psig, and 825° F., using once-through hydrogen.

Figure 1:
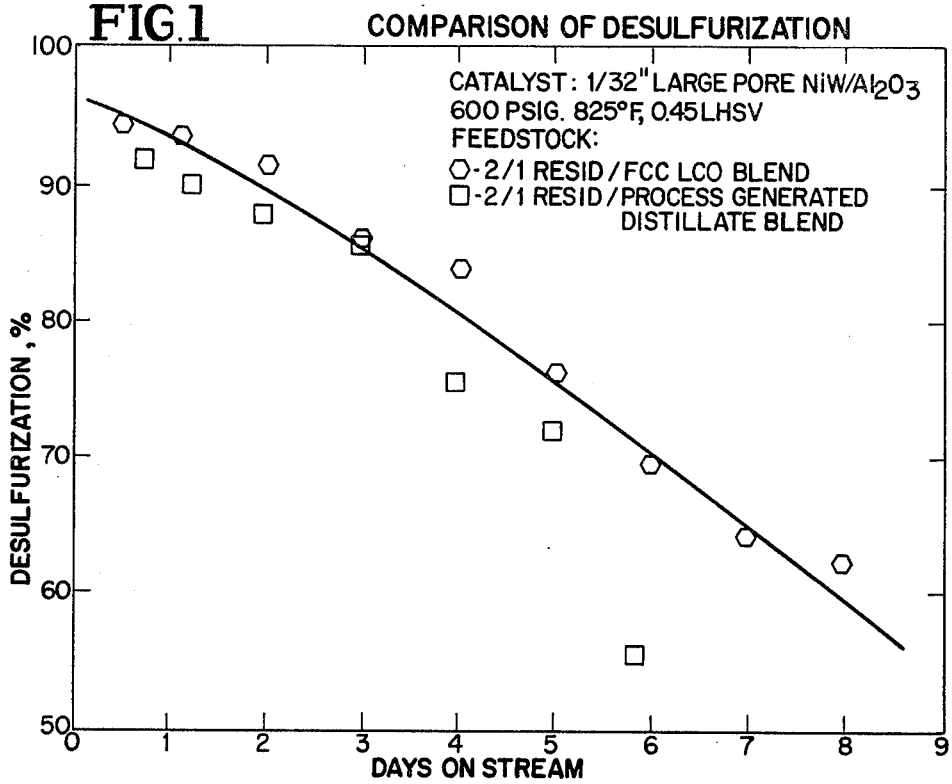
FIG. 1 is a graph showing percentage hydrodesulfurization as a function of catalyst age for a 2/1 blend of Arabian light atmospheric resid/FCC light cycle oil or a 2/1 resid/process-generated distillate blend at 600 psig, 0.45 LHSV, and 825° F.
Figure 2:
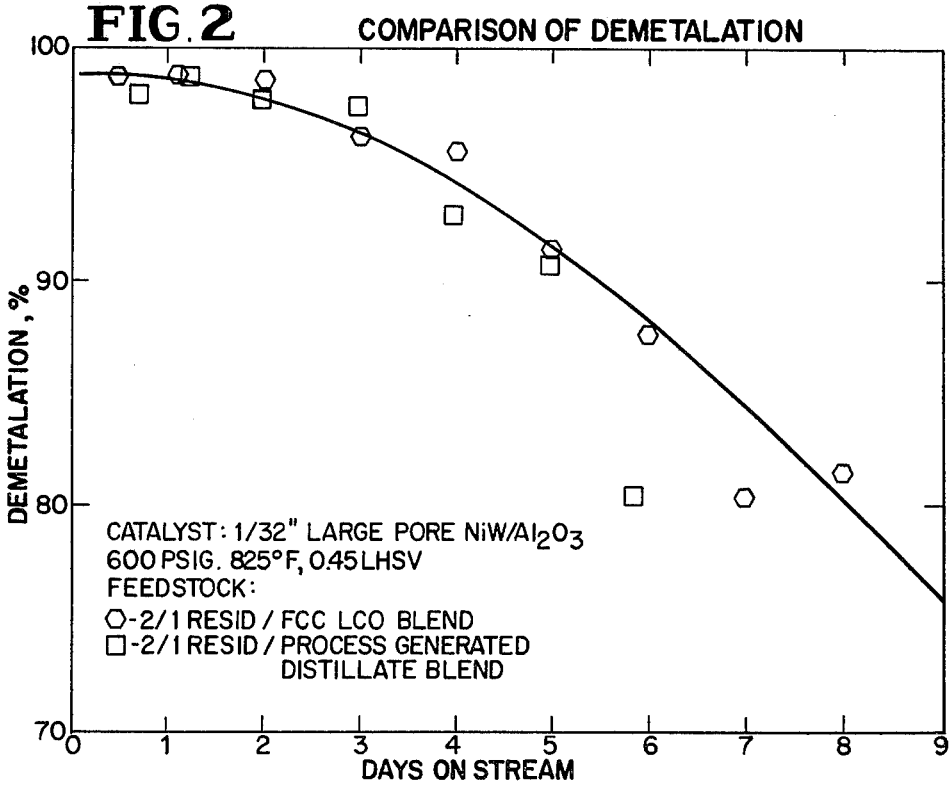
FIG. 2 is a graph showing percentage of total metals removal as a function of catalyst age for the same FIG. 1.
Figure 3:
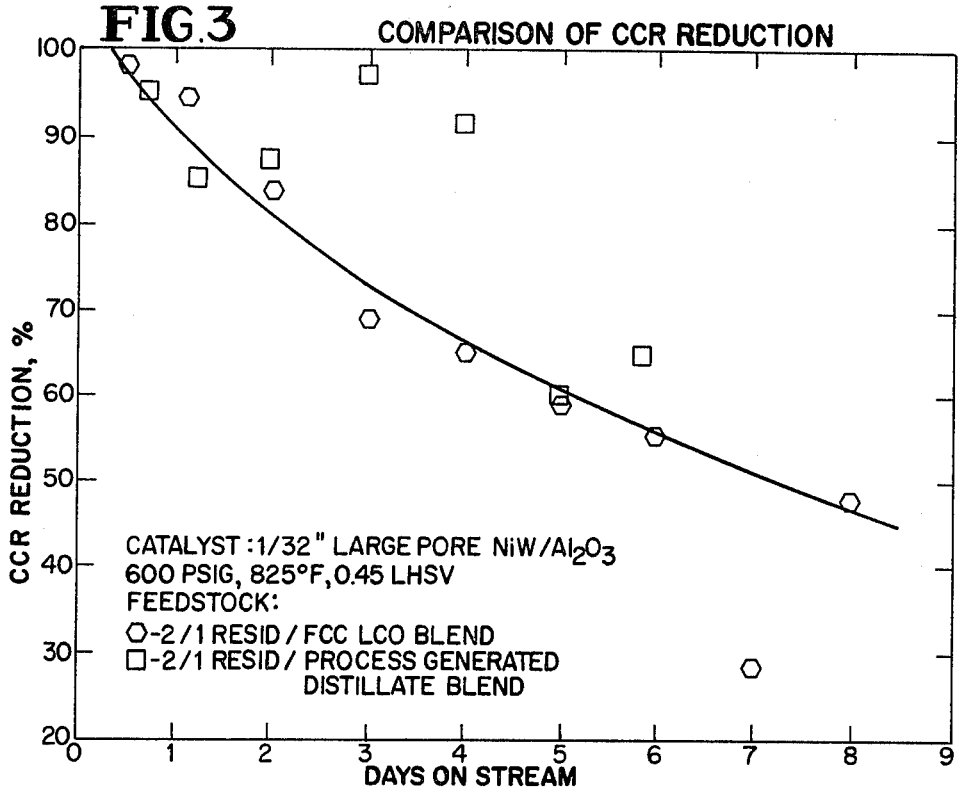
FIG. 3 is a graph showing percentage CCR removal as a function of catalyst age for the same blends as FIG. 1.

The results are plotted in FIGS. 1–3 to show the percentages of desulfurization, demetalation, and CCR removal with days on stream for this large-pore catalyst. After eight days, it retained 60% desulfurization activity, 80% demetalation activity, and 50% CCR removal capabilities, as indicated by the curve in each figure.

EXAMPLE 2

The run was repeated by substituting process-generated distillate for FCC to stock. The distillate was also blended with the resid at a 2/1 ratio. In all other respects, the conditions of Example 1 were unchanged.

The results thereof are also plotted in FIGS. 1–3. They indicate slightly lower desulfurization activity, equivalent demetalation activity, and slightly superior CCR removal activity.

EXAMPLE 3

The same pilot reactor was packed with large-pore catalyst only and was then charged, by feeding at the top, with straight Arabian light atmospheric resid. A run was made at 775° F., 600 psig, and 0.3 LHSV, the catalyst being 50/150 mesh. The product was analyzed, the results being plotted in FIGS. 4–6.

After six days, the large-pore catalyst had 83% of its initial desulfurization capacity, 96% of its demetalation capability, and 67% of its CCR removal capability.

EXAMPLE 4

The reactor was then packed with small-pore catalyst charged with the same resid, and run under the same conditions.

Figure 4:
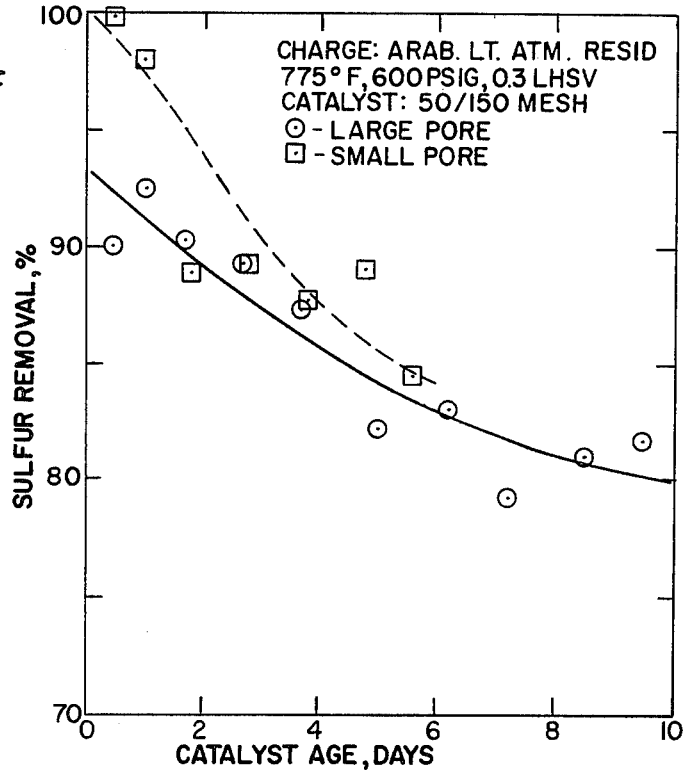
FIG. 4 is a graph showing percentage hydrodesulfurization as a function of catalyst age for large-pore and small-pore catalysts on a charge of Arabian light atmospheric resid at 775° F., 600 psig, and 0.3 LHSV, the catalyst being 50/150 mesh.
Figure 5:
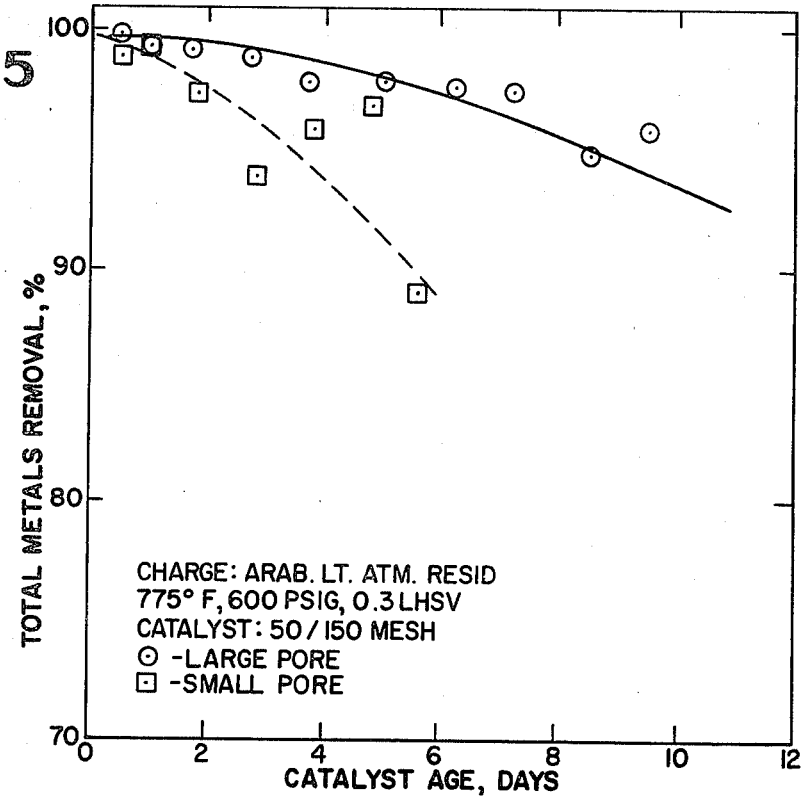
FIG. 5 is a graph showing percentage of total metals removed as a function of catalyst age for the same large-pore and small-pore catalysts and under the same conditions as FIG. 4.
Figure 6:
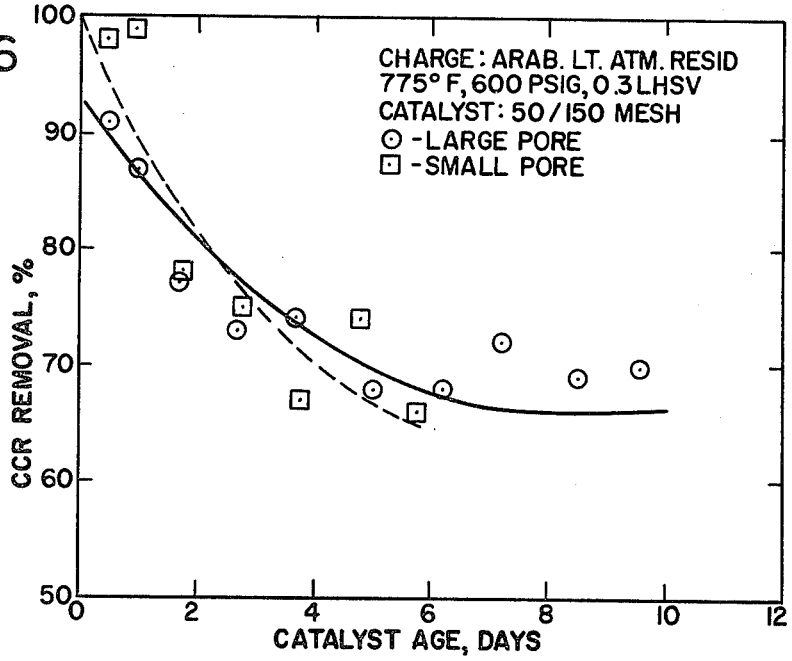
FIG. 6 is a graph showing percentage of CCR removal as a function of catalyst age for the same resid and over the same large-pore and small-pore catalysts as FIG. 4.

FIG. 4 shows percentage of sulfur removal, FIG. 5 shows percentage of total metals removal, and FIG. 6 shows percentage of CCR removal as functions of catalyst age in days for these two runs. The run with the small-pore catalyst had to be terminated after only six days because of reactor plugging.

After six days, the small-pore catalyst retained about 84% of its desulfurization capacity, 88% of its demetalation capacity, and 66% of its CCR removal capability.

It is apparent that small-pore catalyst was somewhat superior for sulfur removal, markedly inferior for total metals removal, and approximately equivalent as to CCR removal to the large-pore catalyst.

EXAMPLE 5

A run was made using a single large-pore $NiW/Al_2/O_2$ catalyst, the properties of which are shown in the following Table, at 600 psig, 0.45 LHSV, and 825° F. The feedstock is a 2/1 blend of Arabian light atmospheric resid and FCC light cycle oil as diluent.

Figure 7:
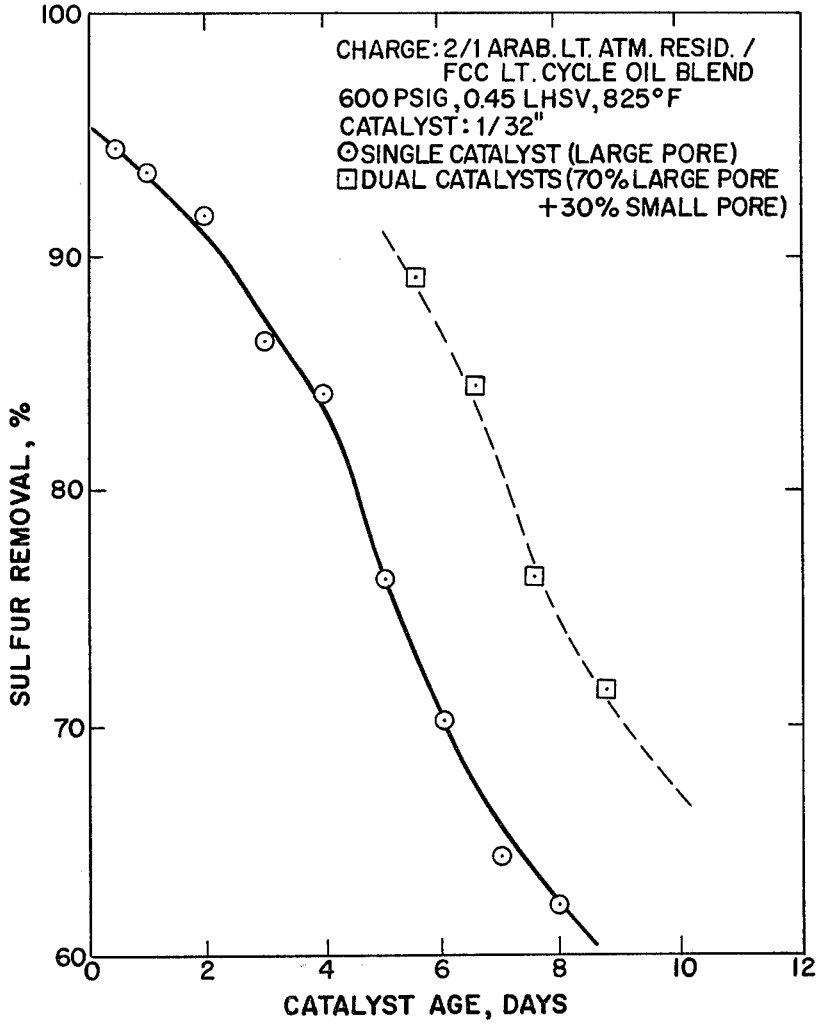
FIG. 7 is a graph showing percentage hydrodesulfurization on a 1/32-inch large-pore catalyst or on a dual catalyst (70% large pore-catalyst followed by 30% small-pore catalyst) at 600 psig, 825° F., and 0.45 LHSV as a function of days on stream when the feestock is a 2/1 resid/FCC light cycle oil (LCO) blend.
Figure 8:
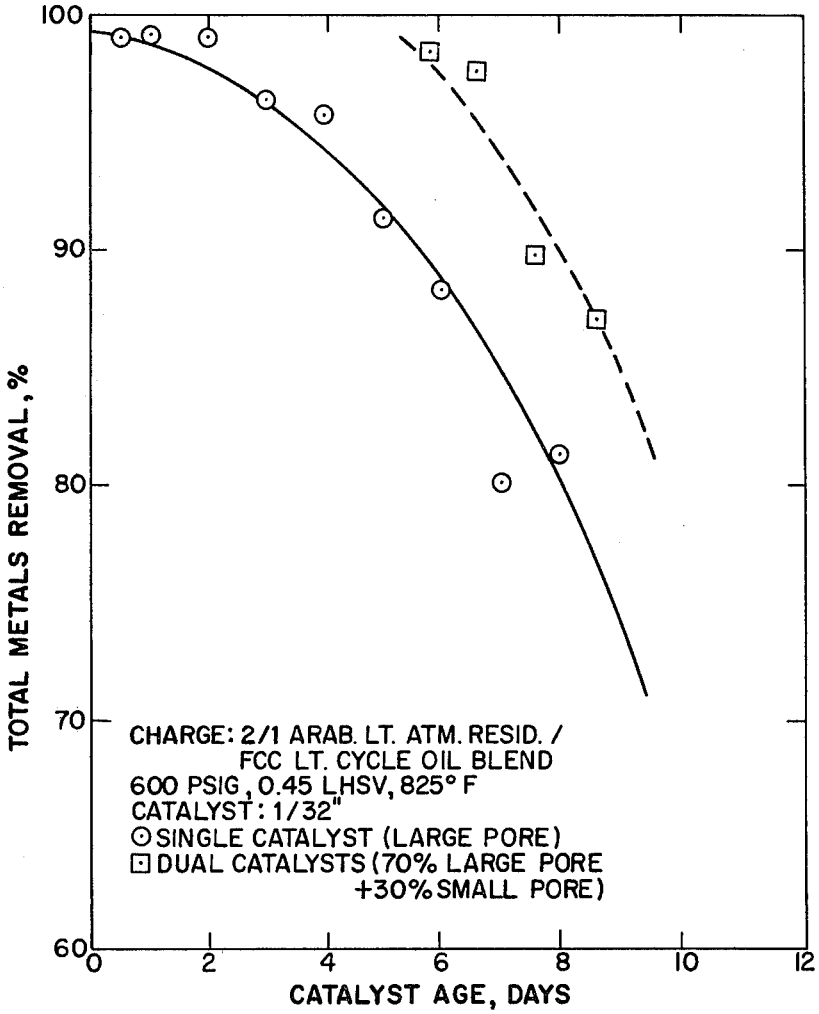
FIG. 8 is a graph showing percentage demetalation as a function of days on stream for the two catalyst systems with the same blend and under the same conditions as FIG. 7.
Figure 9:
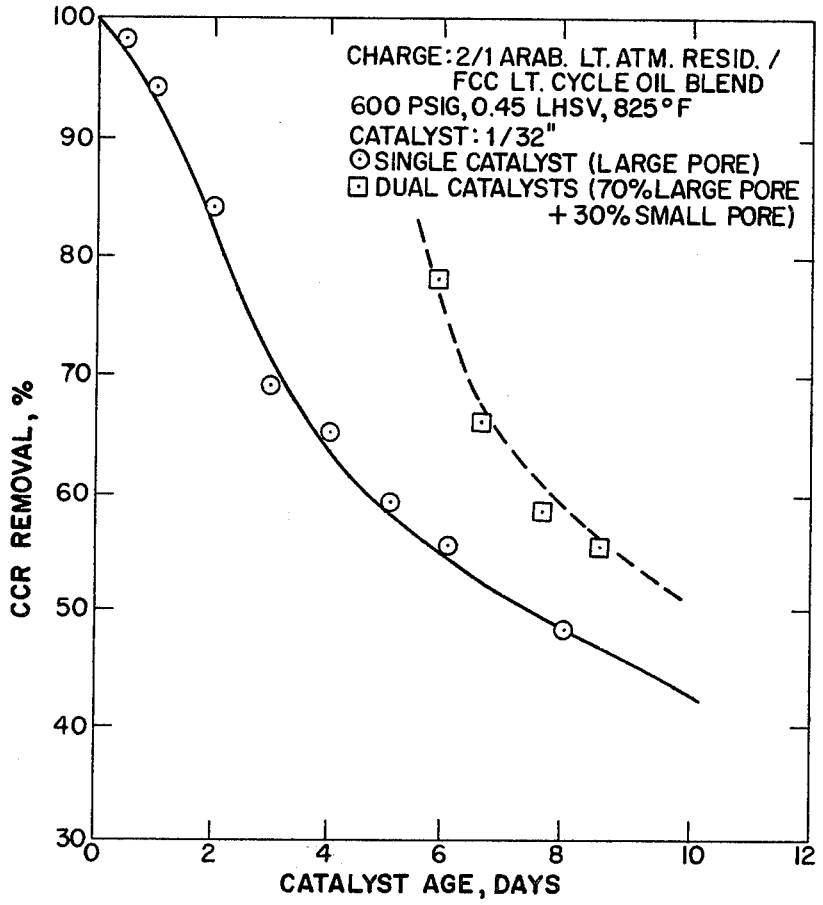
FIG. 9 is a graph showing percentage CCR reduction as a function of days on stream for the two catalyst systems with the same blend and under the same conditions as FIG. 7.

The results are shwon in FIGS. 7–9 as to percentages of sulfur, metals, and CCR removal. It is apparent that after eight days the catalyst retains about 62% of its desulfurization capacity, 80% of its demetalation capacity, and 48% of its CCR removal capacity.

TABLE 1

| Compositions | Catalyst Properties Large Pore | Small Pore |
|---|---|---|
| NiO, Wt. % | 3.5 | 6.5 |
| $WO_3$, Wt. % | 10.0 | 19.7 |
| Physical Properties | | |
| Surface Area, $m^2/g$ | 119 | 216 |
| Pore Volume, cc/g | 0.53 | 0.353 |
| Pore Diameter, Å | 178 | 65 |
| Real Density, g/cc | 3.66 | 3.73 |
| Particle Density, g/cc | 1.25 | 1.61 |
| Pellet Size | 1/32" | 8/14 mesh |
| Pore Size Distribution, cc/g | | |
| 0–30 Å | 0.045 | 0.137 |
| 3–80 Å | 0.025 | 0.218 |
| 80–100 Å | 0.032 | 0.000 |
| 100–200 Å | 0.328 | 0.000 |
| 200–300 Å | 0.066 | 0.000 |

TABLE 1-continued

| Compositions | Catalyst Properties Large Pore | Small Pore |
|---|---|---|
| 300 + Å | 0.034 | 0.007 |

EXAMPLE 6

A dual catalyst, consisting of 70 percent of large-pore catalyst and 30 percent of small-pore catalyst and with the large-pore catalyst above the small-pore catalyst within the reactor, was then tested on the same blend and under the same conditions, except that the run was started at 700° F. and the reactor temperature was increased at 25° F./day up to 825° F. and was thereafter held at 825° F. Percentage of sulfur removal is shown in FIG. 7, percentage of total metals removal is shown in FIG. 8, and percentage of CCR removal is shown in FIG. 9 as functions of catalyst age in days.

It is readily apparent that the dual catalyst system was markedly superior to the single catalyst. The superiority of the dual catalyst system is unexpected because the small-pore catalyst ages significantly faster than the large-pore catalyst and is less active for metals removal, as demonstrated in Examples 3 and 4.

Without desiring to be held to a theory of operation, what is believed to occur is that the large-pore catalyst accepts a large proportion of the sheet-like asphaltenes, thereby enabling these molecules and combinations of molecules to be broken down into smaller molecules (that are not combined with metals) and permitting the metals to be deposited in areas where blockage of small-diameter pores does not occur. As the resid progressed downwardly to the second catalyst bed containing the small-pore catalysts, it is believed that these broken-down smaller molecules, which more easily find access to the small pores of this catalyst, readily enter thereinto, are catalytically broken, and are then hydrogenated to form $H_2S$.

It is to be understood that the invention is not to be limited to the illustrative examples, but its scope and principles are to be integrated in accordance with the following claims.

What is claimed:

1. A catalytic hydrocracking process for direct conversion at low pressure of high-boiling point residua, comprising heteroatoms, metals, sulfur and asphaltenes, to distillate and naphtha, said process comprising cyclic operation of a multi-catalyst bed reactor, containing large-pore catalysts and small-pore catalysts which are $Al_2O_3$ impregnated with tungsten and nickel oxides, said large-pore catalysts having a pore size distribution which is characterized by the majority of pores therein being larger than 100 Angstroms in diameter, and said small-pore catalysts having a pore size distribution which is characterized by substantially all pores therein being no more than 80 Angstroms in diameter, wherein said small-pore catalysts have about twice as much NiO and $WO_3$ as said large-pore ctalysts, have a surface area which is about the surface area of said large-pore catalysts, have a pore volume which is about 70% of the pore volume of said large-pore catalysts, and have an average pore diameter that is about 1/3 of the average pore diameter of said large-pore catalysts, at a pressure of 200–1000 psig, a temperature of 700°–900° F., and a LHSV of 0.1-1-10 by admixing said process-generated distillate, after recycling thereof, with said residua to form solvent-diluted residua and then catalytically hydrocracking, demetalizing, desulfurizing, and decarbonizing said solvent-diluted residua in a single pass-through operation through said reactor in which said large-pore catalysts and said small-pore catalysts are sequentially contacted, said recycled process-generated distillate boiling at about 400°–700° F., so that said operation:

(1) converts said high-boiling point residua to low-boiling point hydrocarbons by forming said distillate and said naphtha while removing said heteroatoms, said metals, and carbon residuals from said high-boiling point residua;

(2) hydrodesulfurizes said high-boiling point residua; and (3) minimizes metals deposition on said catalysts and blocking of said catalysts pores by said asphaltenes, whereby said catalysts remain usable for runs of commercially acceptable length.

2. The process of claim 1, wherein said large-pore catalysts and said small-pore catalysts are distributed in said multi-catalyst bed reactor so that the average pore size of said catalyst decreases gradually from the top of said reactor to the bottom of said reactor, said solvent-diluted residua being fed to said top of said reactor.

3. The process of claim 1, wherein said reactor is packed with said large-pore catalysts in the top thereof, and with said small-pore catalysts in the bottom thereof, said solvent-diluted residua being fed to said top of said reactor.

4. The process of claim 1, wherein said NiO is 3.5% by weight in said large-pore catalysts and 6.5% by weight in said small-pore catalysts.

5. The process of claim 4, wherein said $WO_3$ is 10.0% by weight in said large-pore catalysts and 19.7% by weight in said small-pore catalysts.

6. The process of claim 1, wherein the average pellet size of large-pore catalysts is about 0.03 inch and the average pellet size of said small-pore catalysts is 0.05–0.09 inch.

7. The process of claim 5, wherein said large-pore catalysts and said small-pore catalysts form a dual catalyst system consisting of 70 percent of said large-pore catalysts followed by 30 percent of said small-pore catalysts.

8. The process of claim 7, wherein said residua and said distillate are admixed to form a 2:1 residua/distillate blend for feeding to said multi-catalyst bed reactor as said solvent-diluted residua.

9. The process of claim 1, wherein said pressure is about 600 psig.

* * * * *